US008376561B2

(12) United States Patent
Longo

(10) Patent No.: US 8,376,561 B2
(45) Date of Patent: Feb. 19, 2013

(54) CHEMILUMINESCENT GRENADE

(75) Inventor: Joseph Cosimo Longo, Feeding Hills, MA (US)

(73) Assignee: Cyalume Technologies, Inc., West Springfield, MA (US)

( * ) Notice: Subject to any disclaimer, the term of this patent is extended or adjusted under 35 U.S.C. 154(b) by 406 days.

(21) Appl. No.: 12/839,923

(22) Filed: Jul. 20, 2010

(65) Prior Publication Data

US 2012/0020050 A1 Jan. 26, 2012

(51) Int. Cl.
*F21K 2/06* (2006.01)
*F42B 12/40* (2006.01)

(52) U.S. Cl. ..... 362/34; 102/444; 102/513; 206/219

(58) Field of Classification Search ..... 362/34; 102/444, 513; 206/219–222
See application file for complete search history.

(56) References Cited

U.S. PATENT DOCUMENTS

| | | | | |
|---|---|---|---|---|
| 3,539,794 | A | 11/1970 | Rauhut et al. | |
| 3,576,987 | A | 5/1971 | Voight et al. | |
| 3,664,263 | A | 5/1972 | Driscoll | |
| 3,934,513 | A | 1/1976 | Gabriels | |
| 4,064,428 | A * | 12/1977 | Van Zandt | 362/34 |
| 4,193,109 | A | 3/1980 | Heffernan et al. | |
| 4,508,642 | A | 4/1985 | World | |
| 4,567,831 | A | 2/1986 | Gordon et al. | |
| 4,626,383 | A | 12/1986 | Richter et al. | |
| 4,796,161 | A | 1/1989 | Savariego | |
| 4,814,949 | A | 3/1989 | Elliott | |
| 4,932,672 | A | 6/1990 | Tippmann | |
| 4,944,521 | A | 7/1990 | Greeno | |
| 5,018,449 | A | 5/1991 | Eidson, II | |
| 5,035,183 | A | 7/1991 | Luxton | |
| 5,043,851 | A | 8/1991 | Kaplan | |
| 5,222,798 | A | 6/1993 | Adams | |
| 5,257,936 | A | 11/1993 | Ambrosi et al. | |
| 5,349,906 | A | 9/1994 | Devaux et al. | |
| 5,574,245 | A | 11/1996 | Buc et al. | |
| 5,590,886 | A | 1/1997 | Lush | |
| 5,996,503 | A | 12/1999 | Woodall et al. | |
| 6,253,680 | B1 | 7/2001 | Grubelich | |
| 6,497,181 | B1 * | 12/2002 | Manole et al. | 102/513 |
| 6,619,211 | B1 | 9/2003 | Haeselich | |
| 6,837,713 | B1 | 1/2005 | Kough et al. | |
| 6,871,594 | B1 | 3/2005 | Estrella | |
| 6,981,449 | B2 | 1/2006 | Sadeck | |
| 6,990,905 | B1 * | 1/2006 | Manole et al. | 362/34 |
| 7,444,938 | B2 | 11/2008 | Tippmann | |
| 7,475,638 | B2 * | 1/2009 | Haeselich | 102/513 |
| 7,819,065 | B2 * | 10/2010 | Haeselich | 102/444 |
| 2002/0134274 | A1 * | 9/2002 | Martinez et al. | 102/513 |

FOREIGN PATENT DOCUMENTS

| | | |
|---|---|---|
| WO | WO2005098345 | 10/2005 |

* cited by examiner

*Primary Examiner* — Mariceli Santiago
(74) *Attorney, Agent, or Firm* — McHale & Slavin, P.A.

(57) ABSTRACT

The present invention discloses a non-pyrotechnic, light emitting projectile for marking and illuminating a target. The projectile generally contains a main body having frangible side walls, at least one frangible ampoule containing chemiluminescent reactant components, a substantially incompressible filler material positioned between the frangible side walls and ampoule, and a first and second end cap. The first end cap is designed to be traversable between a first position and a second position upon impact with an object, thus provides a force sufficient to rupture the frangible side walls and ampoules. Rupture of the ampoules causes intermixing of the chemiluminescent reactant components and formation of a chemiluminescent slurry. The second end cap provides sufficient energy transfer to the chemiluminescent slurry upon impact with a target to disperse the chemiluminescent slurry radially and outwardly with respect to the longitudinal axis of the main body.

33 Claims, 5 Drawing Sheets

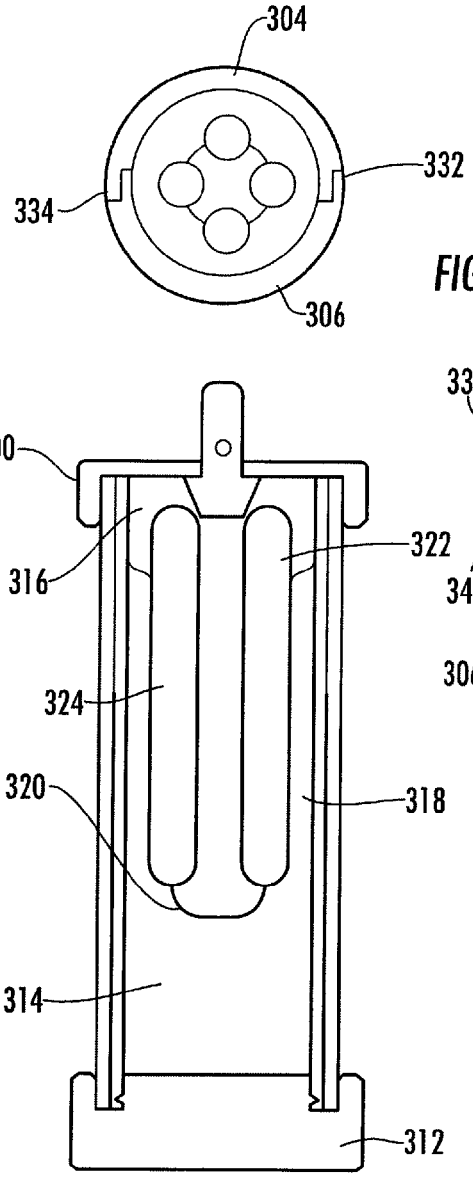
FIG. 3c
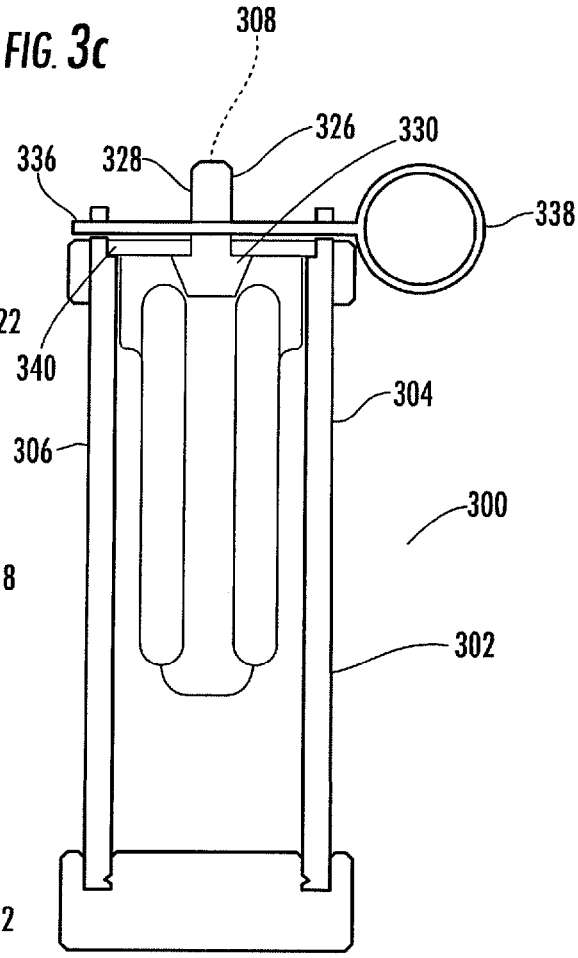
FIG. 3B
FIG. 3A

CHEMILUMINESCENT GRENADE

FIELD OF THE INVENTION

This invention relates to light producing projectiles, particularly to deployable, non-pyrotechnic, chemiluminescent light emitting projectiles for marking or illuminating a target which disperses its contents upon impact in a radially and outwardly direction with respect to the longitudinal axis of the projectile for use in tactical and training exercises.

BACKGROUND OF THE INVENTION

Military and law enforcement personnel worldwide employ a variety of grenade devices, both hand thrown and rifle launched. Payloads include lethal and non lethal explosive charges, chemical agents such as tear gas, smoke, and combinations of elements to create a blinding light and loud noise to disrupt the target ("flash-bang"). Other versions provide a pyrotechnic light source to illuminate an area or target for remote reconnaissance. In addition, in the training of military and law enforcement personnel, a need exists for detecting the accuracy and effectiveness of the trainee's ability to strike an intended target in daylight or darkness. This is important not only for personnel training, but also to determine the effectiveness of various equipment systems, and as a means of calibrating such systems. Training with explosive or pyrotechnic devices present health and safety hazards to the training personnel. While the use of reduced energy devices lessens these hazards, an inherent risk of injury remains as these products employ pyrotechnic reactions or other potentially dangerous stored energy means of activation.

Any grenade that incorporates pyrotechnics is inherently dangerous and presents the risk of unintended ignition of the target or nearby materials. This is problematic in law enforcement deployments where collateral damage is typically undesirable. In many situations the risk of ignition or secondary explosion exceeds the benefits of illuminating the target area, such as when chemicals, flammables, munitions, or other explosive materials may be in or near the target area. Alternative means of illumination, such as use of incandescent lighting can be effective. However, use of direct incandescent lighting is disadvantageous because it reveals the position of the light source and can only illuminate the objects or surfaces it contacts directly. Such directed lighting cannot bypass an opaque barrier, thereby leaving a shadowed area available for concealment.

To overcome the deficiencies of pyrotechnic systems, non-pyrotechnic systems, such as chemical light, has been utilized in both training and real life situations. Typical chemiluminescent light systems produce light by employing a two-component system to chemically generate light. Chemiluminescent light is produced by combining two components, a chemical solution referred to as the "oxalate" component and a chemical solution referred to as the "activator" component. The two components are kept physically separate by a sealed, frangible, glass vial containing one component which is housed within an outer flexible container containing the other component. Typically, this outer container is sealed to contain both the second component and the filled, frangible vial. Forces created by intimate contact with the internal vial, e.g. by flexing, cause the vial to rupture, thereby releasing the first component, allowing the first and second components to mix and produce light. Since the objective of this type of device is to produce usable light output, the outer vessel is usually composed of a clear or translucent material, such as polyethylene or polypropylene, which permits the light produced by the chemiluminescent system to be transmitted through the vessel walls.

Systems utilizing chemiluminescent light output may be designed so as to transmit a variety of colors by addition of a dye or fluorescent compound to one or both of the chemiluminescent reactant compositions or to the vessel. Furthermore, the device may be modified so as to only transmit light from particularly chosen portions thereof. A remotely deployable chemiluminescent system allows the user to easily change positions without affecting the lighting location. Moreover, deployment of chemiluminescent materials provides an illumination that can adhere to it adheres to a target an individual or vehicle so marked is easily and readily identified.

Although pyrotechnic devices have been used to provide colored smoke detections systems, the color and types of illumination is limited. In practice, the ability to use different colors of light and marking by law enforcement and military personnel to indicate differing meanings is vital to the development of an effective system. Moreover, in many situations it is highly desirable for military and law enforcement personnel to have the capability of marking a target non-visibly so that targeted individuals remain unaware of the illumination. To achieve such a goal, invisible radiation in the infrared and ultraviolet can be produced by chemiluminescent reactions.

PRIOR ART

Various marking projectiles are known in the prior art. U.S. Pat. No. 5,035,183 discloses a two-piece polymer projectile consisting of an aero dynamically shaped, thin-shelled, frangible cap, adapted to be filled with a flowable substance for marking upon impact, the fluid sealed within the projectile by a rear plug. The rear plug is relatively rigid in order to contain the expansive effect of propellant gases; a recessed compartment in the rear plug contributes to creating a forward centre of gravity for the projectile; the barrel rifling is engaged by the projectile in the region of the rear plug only, whereby positive engagement with the barrel rifling imparts spin without bursting the cap portion of the projectile; an indentation region on the nose of the cap facilitates flexing of the score lines for rapid and efficient bursting of the cap on impact.

U.S. Pat. No. 6,253,680 discloses a diversionary device having a housing with at least one opening and containing a non-explosive propellant and a quantity of fine powder packed within the housing, with the powder being located between the propellant and the opening. When the propellant is activated, it has sufficient energy to propel the powder through the opening to produce a cloud of powder outside the housing. An igniter is also provided for igniting the cloud of powder to create a diversionary flash and bang, but at a low enough pressure to avoid injuring nearby people.

U.S. Pat. No. 5,222,798 discloses a battery powered device that may be thrown or fired into position as a non-injurious agent of coercive intervention. Light is emitted after a predetermined delay. The light produced shines sufficiently brightly so as to be temporarily blinding to the direct view of any human who is close enough to the light source so as to touch it.

U.S. Pat. No. 7,444,938 discloses a paintball grenade having and outer bladder and an inner bladder. The inner bladder is filled with a colored liquid. The inner bladder ruptures on impact with the target; the outer bladder does not rupture but releases the liquid through an opening.

U.S. Pat. No. 5,996,503 discloses a reusable gas-powered hand grenade. A sealed reservoir is maintained in the housing for storing a gas under pressure. A rupturing device is mounted in the housing for breaking the reservoir's seal upon impact therewith. A triggering mechanism coupled to the rupturing device maintains separation between the rupturing device and the seal until the triggering mechanism is activated.

U.S. Pat. No. 5,590,886 discloses a reusable, mechanically powered paint ball grenade utilizing 0.68 or smaller diameter paint balls. Once thrown downrange the actuator will function upon impact allowing the grenade halves to collapse with the force of the primary spring, crushing the paint balls against cutters and causing the paint to be hydro mechanically dispersed about the exterior of the device.

U.S. Pat. No. 5,257,936 discloses an inert training grenade intended to be fired by a rifle and a propellant cartridge, comprising a metal tube and with a front solid part which closes off the tube. This front part carries a hollow nose containing a marking substance. The nose is sufficiently resistant to withstand the shot, but is destructible on impact.

U.S. Pat. No. 5,018,449 discloses a paint dispersing training grenade that includes a grenade body having dispersing passages, a plug received in one end of the bore, a piston resiliently urged by a spring toward the plug, a rupturable colorant containing capsule positioned between the piston and the plug, a separable release lever, and an inertial delay mechanism engaged between the grenade body and the piston. The delay mechanism includes pivotable delay levers engaged with the piston at one end and having wheels rollably engaging a surface of the grenade body at another end. When the release lever is separated, movement of the piston by the spring is resisted by startup inertia of the wheels in rotating. When the inertia is overcome, the piston forcibly ruptures the capsule and propels the colorant out of the grenade body through the dispersion passages.

U.S. Pat. No. 4,944,521 discloses a war game marking grenade with a piercing mechanism to pierce an enclosed gas cylinder. The gas from the cylinder is directed into channels and impels gelatin enclosing fluid marking spheres exteriorly of the grenade for marking purposes.

U.S. Pat. No. 4,932,672 discloses an impact actuated non-lethal hand grenade having a flexible, resilient casing containing a pressurized marking fluid. The casing has an opening and a ball received within the opening, whereby, when the hand grenade is thrown, the subsequent impact of the grenade with an object and the resulting hydrostatic shock through the fluid within the grenade will dislodge the ball from the opening allowing the discharge of fluid from the opening and onto surrounding objects.

Chemiluminescent light systems are well known in the art. Several examples of such systems include U.S. Pat. Nos. 3,539,794, 3,576,987, 4,193,109, 4,508,642, 4,626,383, 4,814,949, and 5,043,851, the subject matter of which patents are incorporated herein by reference.

Use of chemiluminescent light systems for projectile marking is also known in the art. For example, U.S. Pat. No. 7,475,638 discloses a training projectile, usually fired from a weapon with a rifled barrel, having a hollowed arched cap at its head. The hollowed arched cap defines a hollow cavity within the head of the projectile. Into the cavity region is placed an inactive chemical marking material such as a colored powder for use of producing a color effect. The cavity also has a second active chemical material for producing light. The two materials are release to the external environment upon striking a target as the hollowed arched head portion bursts upon impact.

U.S. Pat. No. 6,990,905 discloses a non-lethal chemiluminescent marking projectile that provides site identification capability of a target upon impact. The projectile contains a breakable container system and a foam filler. The container system breaks on a setback impact that is exerted during firing and initial launch, causing the chemiluminescent reagents to mix and be absorbed into the foam filler, such that upon impact of the projectile with the target, the foam filler marks the target with the mixed chemiluminescent reagents diffused therein.

U.S. Pat. No. 6,619,211 discloses a practice ammunition projectile which comprises a head which bursts when the projectile strikes a target and contains a marking agent which optically indicates the point of impact after the head has burst. The marking agent consists of several chemical components which are each contained in separately breakable compartments within a burstable hood at the head of the projectile.

U.S. Pat. No. 4,796,161 discloses an apparatus for providing selected coincident actuation of a plurality of chemical light sources to provide a relatively intense light source which is actuated at a precisely selectable time.

One of the main disadvantages of several of the cited prior art references described above lies in the utilization of pyrotechnic or other stored energy mechanisms, making use of such device as a training tool inherently dangerous. Grenades utilizing such energy mechanisms adapted to fit a rifle increase the risk of the grenade's pyrotechnic charge inadvertently being detonated by the firing of the rifle. Inadvertent detonation obviously increases the danger of fatal or severe injury to the gunner and anyone in the surrounding area. While several cited prior art references do in fact teach the use of chemiluminescent lighting systems for marking devices, these devices have minimal dispersing ability as light dispersal described in the references is restricted to the tips, thus limiting their ability to act as a marking and illumination device.

Therefore, what is lacking in the art is a chemiluminescent projectile which can be used by military or police personnel which eliminates the inherent dangers of pyrotechnic devices, is capable of remotely and/or surreptitiously deploying daytime/nighttime marking or illuminating materials, does not produce chemiluminescent until impact with a target, and disperses light radially and outwardly.

SUMMARY OF THE INVENTION

The present invention discloses a non-pyrotechnic, light emitting projectile for marking and illuminating a target. The projectile generally contains a main body having frangible side walls, at least one frangible ampoule containing chemiluminescent reactant components, a substantially incompressible filler material positioned between the frangible side walls and at least one ampoule, and a first and second end cap. The first end cap is constructed and arranged to connect to a portion of the frangible side walls and to receive a portion of the ampoules. The first end cap is designed to be traversable between a first position and a second position upon impact with an object. The traversal between the first position and the second position provides a force sufficient to rupture the frangible side walls. The force produced further ruptures the ampoules, causing intermixing of the chemiluminescent reactant components to produce light. The chemiluminescent reactant components further admix with a substantially incompressible filler material to produce a chemiluminescent slurry. The second end cap is constructed and arranged to connect to the frangible side walls and to receive a portion of at least one ampoule. The second end cap provides sufficient energy transfer to the chemiluminescent slurry upon impact with a target to disperse the chemiluminescent slurry radially and outwardly with respect to the longitudinal axis of the main body.

The instant invention also discloses a non-pyrotechnic, light emitting hand grenade. The hand grenade contains a main body defined by side walls radially displaced along a longitudinal axis and constructed and arranged to engage a front end cap and a bottom end cap. The inner portion of the hand grenade contains a first chamber and a second chamber. The first chamber is defined by an ampoule supporting device constructed to hold at least one frangible ampoule containing chemiluminescent reactant components and at least one frangible ampoule containing chemiluminescent reactant components. The second chamber is defined by the space between the ampoule supporting device, the bottom end cap and the side walls and contains inert filler, marker materials, or combinations thereof. The hand grenade further contains a striker element having an upper portion projecting outwardly through the front end cap and a lower portion directed towards the ampoules. As force is exerted upon the upper portion, the lower portion breaches the ampoules, causing intermixing of the chemiluminescent reactant components to produce light. The grenade is thrown toward a target wherein impact of the end caps with the target results in a force sufficient to dislodge the end caps. Dislodgement of the end caps results in intermixing of the chemiluminescent reactant components with the inert filler mixture, marker materials, or combinations thereof located in the second chamber to form a chemiluminescent slurry. Dislodgement of the side walls results in radial, outward displacement of the chemiluminescent slurry.

In general, use of chemilumescent light production utilizing a two-component system, such as a liquid phase oxalate ester chemical light system, must comprise an "oxalate component" comprising an oxalic acid ester and a solvent, and a "peroxide component" comprising hydrogen peroxide and a solvent or mixture of solvents. Typically, these two chemical solutions are referred to as the "oxalate" component and the "activator" component. In addition, an efficient fluorescer must be contained in one of the components. An efficient catalyst, necessary for maximizing intensity and lifetime control, may be contained in one of the components.

The oxalate component provides an oxalate ester-solvent combination which permits suitable ester solubility and storage stability. The peroxide component provides a hydrogen peroxide-solvent combination which permits suitable hydrogen peroxide solubility and storage stability.

The solvents of the two components may be different but must be miscible. At least one solvent solubilizes the efficient fluorescer and at least one of the solvents solubilizes the efficient catalyst.

Therefore, the term "chemiluminescent reactant components" as used herein is interpreted to mean a mixture of components, such as the oxalate or activator, or individual components, such as oxalic acid ester, a oxylate solvent, hydrogen peroxide, an activator solvent, fluorescer, which when intermixed produces a chemiluminescent reaction. While the two component system typically requires the "oxalate" component and the "activator" component to be separated, separation may occur within a single container or by using several containers containing various reactants. In either case, rupture of the containers causes intermixing and generates light production.

The term "substantially incompressible filler material" as used herein is interpreted to mean any material, including liquids, solids, slurries, powders, granules, which when subject to a tensile or compression strain or force does not change volume.

Accordingly, an objective of the instant invention is to teach light emitting projectile for marking and illuminating a target which disperses its contents upon impact in a radially and outwardly direction with respect to the longitudinal axis of the projectile.

It is a further objective of the instant invention is to teach a remotely deployable light emitting projectile for marking and illuminating a target which disperses its contents upon impact in a radially and outwardly direction with respect to the longitudinal axis of the projectile.

It is another objective of the instant invention to teach a daytime/night time viewable light emitting projectile for marking and illuminating a target which disperses its contents upon impact in a radially and outwardly direction with respect to the longitudinal axis of the projectile.

It is a further objective of the instant invention to teach a light emitting hand or rifle grenade for marking and illuminating a target which disperses its contents upon impact in a radially and outwardly direction with respect to the longitudinal axis of the projectile.

It is a another objective of the instant invention to teach a remotely deployable chemiluminescent grenade in which the chemiluminescent and marking components may be intermixed in flight and dispersed upon impact.

It is yet a further objective of the instant invention to teach a light emitting projectile for marking and illuminating a target which disperses visible light upon impact in a radially and outwardly direction with respect to the longitudinal axis of the projectile.

It is yet a further objective of the instant invention to teach a light emitting projectile for marking and illuminating a target which disperses infrared or ultraviolet light upon impact in a radially and outwardly direction with respect to the longitudinal axis of the projectile.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objectives and features thereof.

BRIEF DESCRIPTION OF THE DRAWINGS

FIG. 3A shows a sectional, front view of an illustrative embodiment of a light emitting hand grenade prior to deployment, including the safety pin configuration in a non-deployed state.

FIG. 3B shows a back view of the light emitting hand grenade of FIG. 3A.

FIG. 3C illustrates a cross sectional view taken along the line 3B-3B of FIG. 3A, illustrating the joint between the outer walls of the main body portion.

DETAILED DESCRIPTION OF THE INVENTION

The present invention discloses a non-pyrotechnic, light emitting projectile for marking and illuminating a target. The projectile generally contains a main body having frangible side walls, at least one frangible ampoule containing chemiluminescent reactant components, a substantially incompressible filler material positioned between the frangible side walls and at least one ampoule, and a first and second end cap. The first end cap is constructed and arranged to connect to a portion of the frangible side walls and to receive a portion of the ampoules. The first end cap is designed to be traversable between a first position and a second position upon impact with an object. The traversal between the first position and the second position provides a force sufficient to rupture the frangible side walls. The force produced further ruptures the ampoules, causing intermixing of the chemiluminescent reactant components to produce light. The chemiluminescent reactant components further admix with a substantially incompressible filler material to produce a chemiluminescent slurry. The projectile contains a second end cap constructed and arranged to connect to the frangible side walls and to receive a portion of one or more ampoulea. The second end cap provides sufficient energy transfer to the chemiluminescent slurry upon impact with a target to disperse the chemiluminescent slurry radially and outwardly with respect to the longitudinal axis of the main body.

Figure 1A:
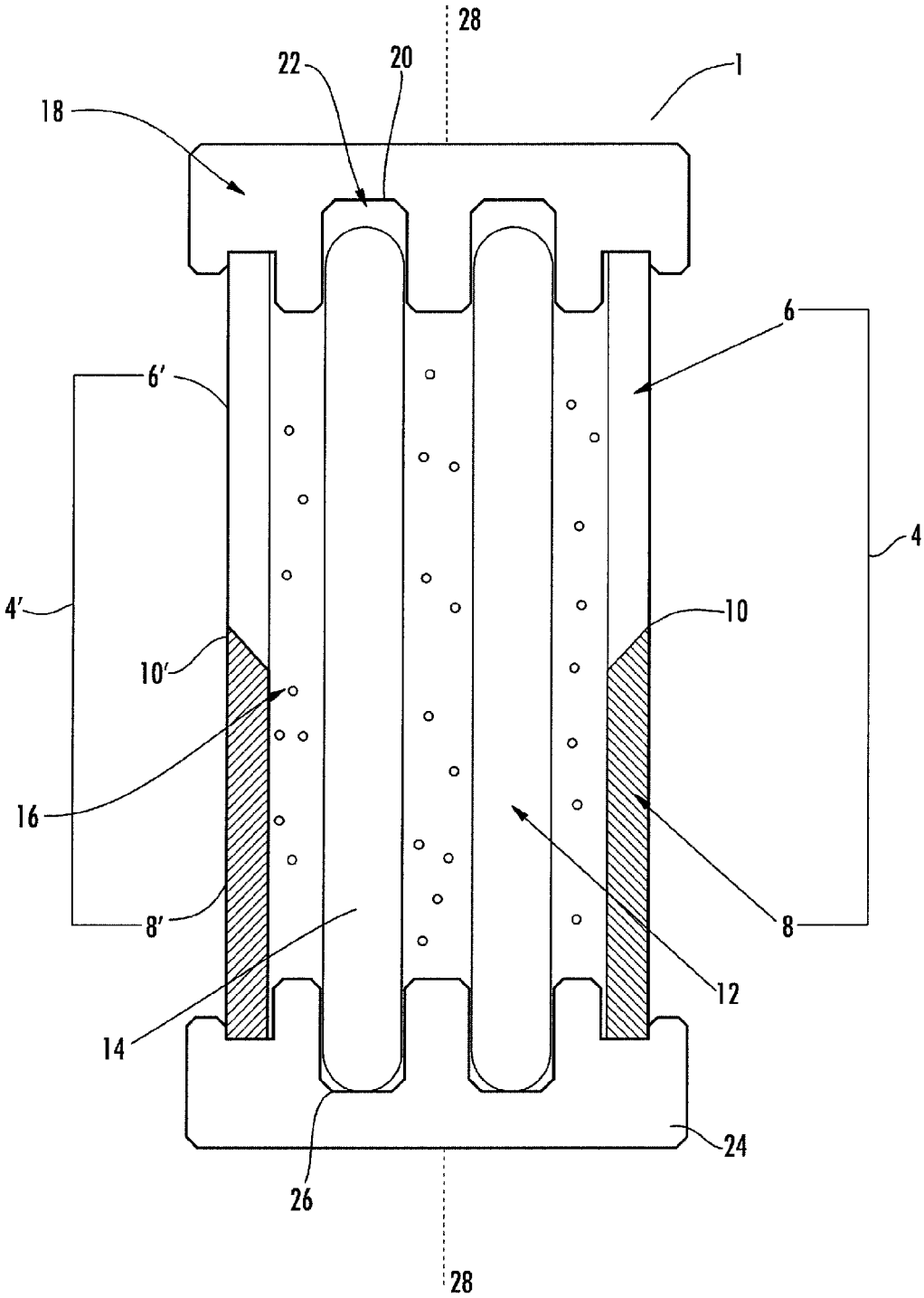
FIG. 1A shows a sectional view of an illustrative embodiment of a light emitting projectile for marking and illuminating a target prior to deployment.
Figure 1B:
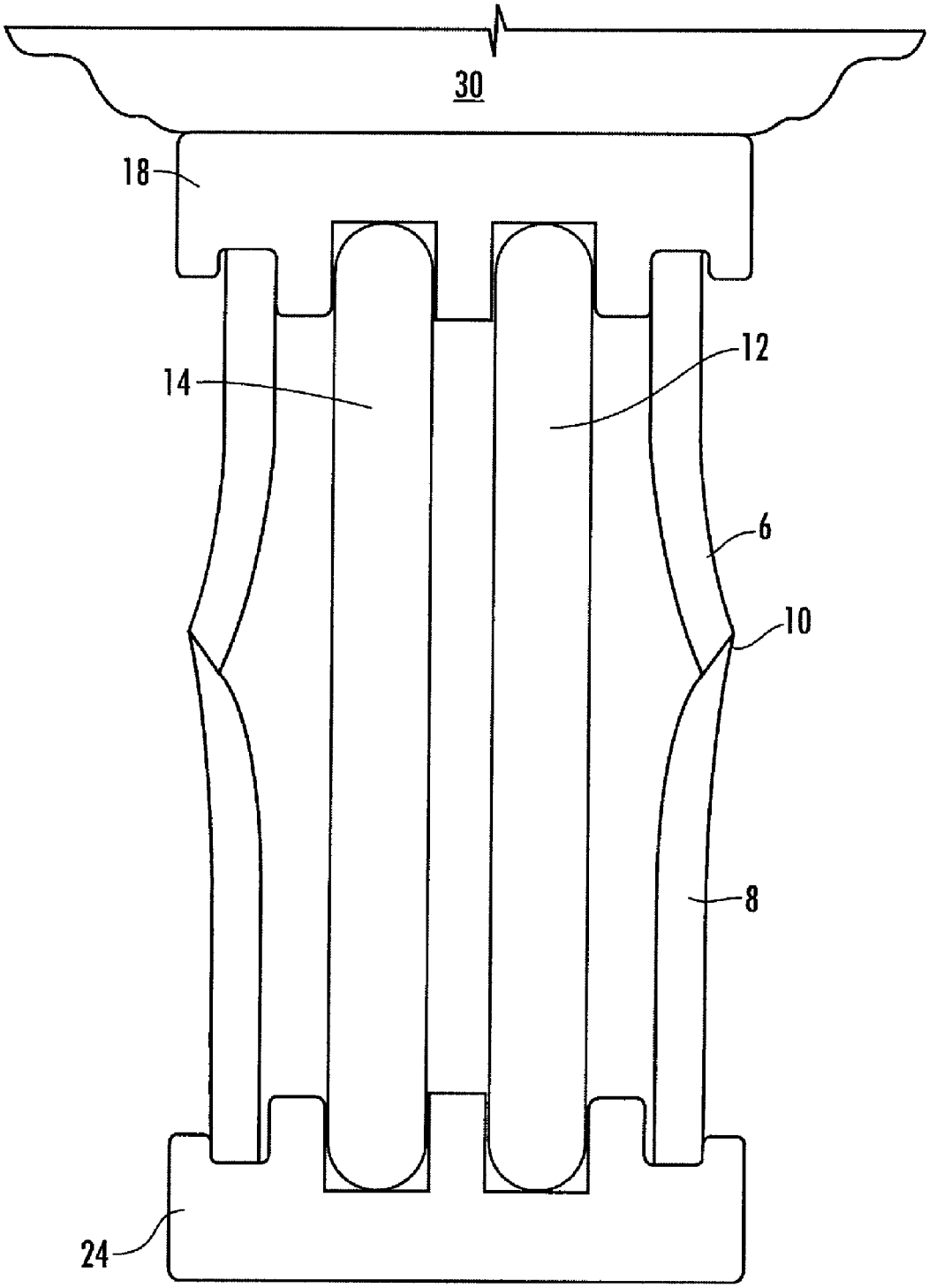
FIG. 1B shows a sectional view of the particular embodiment illustrated in FIG. 1A upon impact with a target.
Figure 1C:
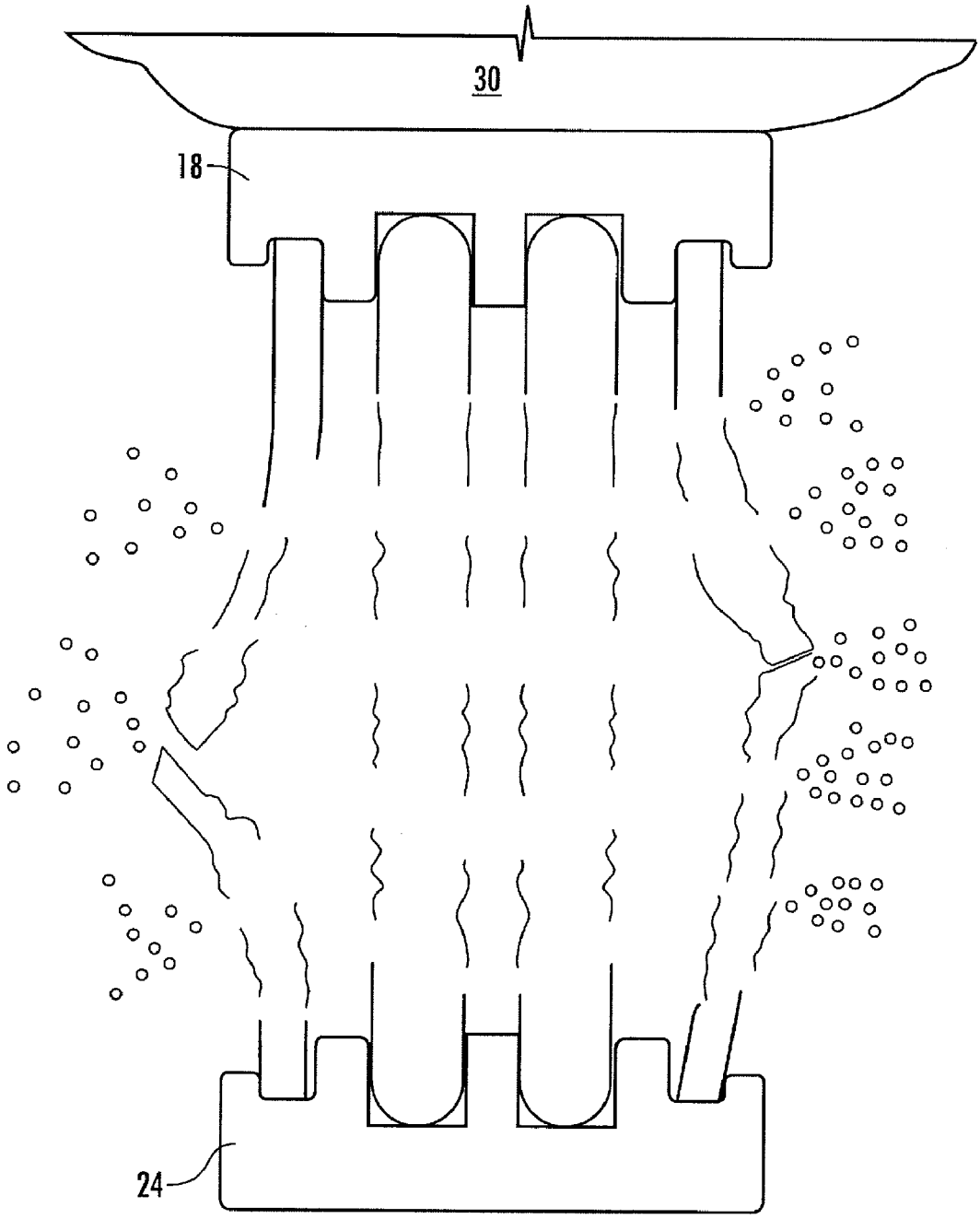
FIG. 1C shows a sectional view of the particular embodiment illustrated in FIG. 1A, illustrating the effects of impact force upon the light emitting projectile.

FIGS. 1A-1C show an illustrative example of the non-pyrotechnic, light emitting projectile for marking and illuminating a target. Referring to FIG. 1A, light emitting projectile 1 contains a main body 2 having frangible side walls 4 and 4'. As illustrated, frangible side walls 4 and 4', herein referred to collectively as 4, are multicomponent side walls, having a first member side wall, 6 and 6', respectively, herein referred to collectively as 6, and a second member side wall, 8 and 8', respectively, herein referred to collectively as 8. Multicomponent side walls 4 are constructed such that first member side wall 6 adjoins or abuts a second member side wall 8, such as along a frustoconical surface 10 and 10'. Contained within the multicomponent side walls 4 is one ampoule or a plurality of ampoules, 12, 14 containing chemiluminescent reactant components. Ampoules 12, 14 are designed to be frangible containers and can be made of any material that accomplishes such a task, including glass, plastics or a suitable combination thereof. A preferred embodiment is the use of glass, as such material is known to have a high tensile strength relative to thickness. As such a frangible glass ampoule may be fabricated that has significant longitudinal strength but relatively weak latitudinal resistance to failure. A substantially incompressible filler material 16 is positioned between multi-component side walls 4 and the ampoules 12, 14. The substantially incompressible filler material 16 can be a liquid, solid, or slurry and be composed of marker material, such as fluorescent marker powder, inert filler, such as but not limited to marble dust (calcium carbonate), granulated or powdered polyvinyl chloride (PVC) resin with or without additional dyes, glass beads, sand, plastic resin pellets (PVC or any other suitable polymer), or the like, or combinations thereof. The addition of the marker material and inert filler mixture 16 to the spaces between the ampoules strengthen the relatively weak latitudinal resistance to failure and further act to dampen vibrational shock that may occur during normal handling.

A first end cap 18 is constructed and arranged to connect to first member side wall 6 and to receive a portion of the frangible ampoules 12 and 14. For example, side walls 6 and 8 can be interlocked with the end cap 18 by a mechanical joint with or without gasket material which provides the capability of containing the marker material and inert filler mixture. The combined height of first member side walls 6 and second member side walls 8 may be constructed to be greater than the length of frangible ampoules 12 and 14. First member side walls 6 and second member side walls 8 and end caps 18 and 24 therefore act in concert to prevent compressive forces from prematurely rupturing the ampoules 12 and 14. As illustrated, first end cap 18 has at least one inner cavity 20 for receiving a portion of the ampoules. The portion of ampoule 12 or 14 that is received by the inner cavity 20 may be separated from the inner cavity base 20 by a space 22. Use of inner cavity 20 provides positioning and alignment of ampoules 12 and 14. Ampoules 12, may be held in place with first end cap 18 through a mechanical fit, such as frictional fitting, or through the use of adhesives. First end cap 18 is traversable between a first neutral position, and a second triggering position upon impact with an object. Traversal between the neutral position and the triggering position provides a force sufficient to rupture the side walls as well as the ampoules, causing intermixing of the chemiluminescent reactant components and admixture with the substantially incompressible filler material to produce a chemiluminescent slurry. Chemiluminescent light produced may fall within the spectrum of visible light, infrared light, ultraviolet light, or combinations thereof.

Light emitting projectile 1 further contains a second end cap 24 constructed and arranged to connect to second member side wall 8 and to receive a portion of ampoules 12, 14. In a similar manner as described above, a preferred embodiment of the second end cap 24 also contains at least one inner cavity 26 for receiving a portion of the ampoules. Second end cap 24 provides sufficient energy transfer to the chemiluminescent slurry upon impact with a target to disperse the chemiluminescent slurry radially and outwardly with respect to the longitudinal axis 28 of the main body. Depending on the need of the user, projectile 1 can be made of opaque, transparent, or translucent materials and can be constructed of biodegradable or inert materials.

The arrangement of end cap 18 with first member side walls 6 and ampoules 12 and 14 as illustrated in FIG. 1A represents first member 18 in the neutral position. This position represents the projectile in a non-impacting state. In such a position, ampoules 12 and 14 are an integral part of the overall projectile integrity. Use of inner cavity 22 further provides positioning and alignment of ampoules 12 and 14. First member side walls 6, second member side walls 8, and first end cap 18 therefore act in concert to prevent compressive forces from prematurely rupturing the ampoules 12 and 14. As the object is launched at a target, impact of the projectile 1 results in end cap 18 traversing to the triggering position, see FIG. 1B.

FIG. 1B illustrates end cap 18 in the triggering position. As projectile 1 impacts target 30, the force of impact either pushes first end cap 18 toward ampoules 12 and 14 or the motion or inertia of the projectile pushes ampoules 12 and 14 toward first end 18. Either movements, or a combination of the two movements, can be defined as the triggering position. In this situation, traversal of end cap 18 to the triggering position results in rupture of the ampoules due to the impact shock/force from end cap 18 which can be made of a dense and rigid material transmitting a transverse force upon the ampoules. Ampoule rupture causes intermixing of the chemiluminescent reactant components and the production of light.

As the chemiluminescent reactant components are released from ampoules 12 and 14, they are free to admix with the substantially incompressible filler material to produce a chemiluminescent slurry. The force generated as end cap 18 traverses to the triggering position also results in stress to the side walls, forcing the side walls to bow, separate, or blow out at the abutment of first member side walls 6 and second member side walls 8. Latitudinal stresses resulting from sidewards impact may further provide a source of side wall destruction. The latitudinal forces generated from a side impact can further be mechanically advantaged by the leverage created from the use of different diameters of end caps relative to the side walls and the readily separable joint between the side walls, or a combination of the forces. As projectile 1 is launched to the target area, any kinetic energy stored within the second end cap 24, which can also be made of a dense and rigid material, is converted into potential energy upon impact. As second end cap 24 continues to move forward towards the target, sufficient force or energy is transferred to the chemiluminescent slurry to disperse the chemiluminescent slurry, radially and outwardly with respect to the longitudinal axis of the main body. Dispersal of chemiluminescent slurry upon the target is commensurate with the impact velocity, angle of impact, and firmness of the impact site, among other factors.

Figure 2:
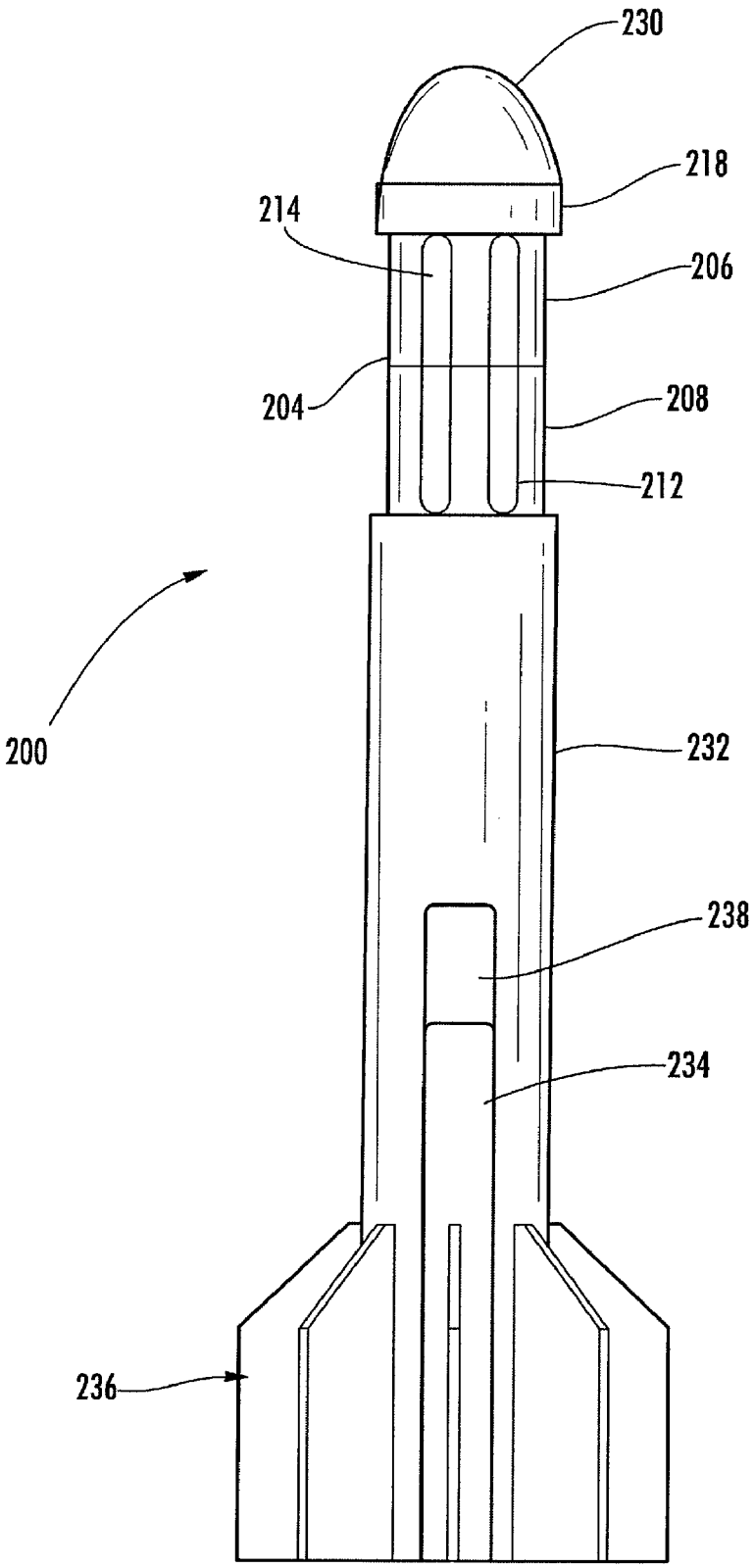
FIG. 2 shows an illustrative embodiment of the light emitting projectile for marking a target which has been adapted for use with a grenade launching device.

The chemiluminescent projectile as described above can be adapted for use with various launching devices, such as rocket propelled grenade launchers or rifle grenade launchers. FIG. 2 discloses a particular embodiment of a chemiluminescent projectile configuration 200 adapted for a rifle grenade. Accordingly, the chemiluminescent projectile configuration 200 can be adapted to fit any weapon, including but not limited to any rifle, under-barrel grenade launcher, anti-tank grenade launcher, or the like, and use any mechanism that launches and propels the grenade off the weapon, including use of blank rounds or blank rounds with an adapter plate, or modern bullet traps. Bullet trap-style mechanisms utilize the firing of a bullet into a trap to catch the bullet prior to exiting the muzzle of the weapon. The energy produced by the firing of the bullet propels the grenade. Additionally, some modern grenades contain a hole through the center of the grenade providing a means for the bullet to escape subsequent to firing. The mechanism of propelling the grenade utilizes the gun's gas expanding from the muzzle as a propellant.

In a conventional bullet-trap style embodiment, projectile 200 has an end cap 218 which is internally congruent to that shown in FIG. 1 but with an aerodynamic, substantially conical or ogive-like external configuration, 230. The outer walls 304 may be analogous to the side walls as illustrated in FIG. 1, thus containing first member side walls 206 and second member side walls 208. First member side walls 206 and second member side walls 208 are interconnected together as described previously, or may be telescoping in design and construction. Contained within inner walls 306 and 308 are ampoules 212 and 214 containing chemiluminescent reactant components. A second end cap, not pictured, may be identical to that shown in FIG. 1 and attached to the tail section. The second end cap may also have salient features previously detailed as being incorporated into a larger component. Not illustrated are ampoules which contain the chemiluminescent reactant components which are arranged similarly to the embodiment described in FIG. 1. Attached to or constructed as a part of the second end cap is an elongated body section, 232. The elongated body section, 232 contains an internal bore 234 which enables mounting of the rifle grenade to any muzzle, such as but not limited to, a rifle muzzle, either directly or through an adaptor. At the aft end of projectile 200 are a plurality of stabilizing fins 306. Projectile 200 may also contain a bullet trap section 238 positioned distal to the internal bore which is designed to capture the bullet when fired. Bullet traps such as those described in U.S. Pat. No. 3,664,263, U.S. Pat. No. 3,934,513, U.S. Pat. No. 4,567,831, U.S. Pat. No. 5,349,906, U.S. Pat. No. 5,574,245, and U.S. Pat. No. 6,981,449 or any construction design known to one of skill in the art which captures a fired bullet can be incorporated within the projectile 200. The captured bullet and forces of the expanding gases generated from said firing propel the rifle grenade to the target.

FIGS. 3A-3C show an illustrative embodiment of a non-pyrotechnic, light emitting hand grenade. Referring now to FIGS. 3A and 3B, non-pyrotechnic, light emitting hand grenade 300 has a main body defined by side walls 304 and 306 radially displaced along a longitudinal axis 308. Side walls 304 and 306 engage a front end cap 310 and a bottom end cap 312 to form an interior portion 314. The joints between outer walls 304 and 306 and top and bottom end caps 310 and 312 can be constructed to be primarily frictional in design with a slight detent for a secure fit. Additionally, the joints may contain a gasket type material such as an "o"-ring to assure retention of the device contents during routine handling.

Interior portion 314 contains a first chamber 316 and a second chamber 318. First chamber 316 is defined by an ampoule supporting device 320 constructed to hold one frangible ampoule or multiple frangible ampoules containing chemiluminescent reactant components, and frangible ampoules 322 and 324 containing chemiluminescent reactant components. The ampoule supporting device 320 partially encloses the rupturable, frangible containers exemplified by ampoules 322 and 324, keeping them aligned with the longitudinal axis of the device. The spaces between ampoule 322 and 324 and the space between ampoules 322 and/or 324 and outer walls 304 and 306 are partially filled with a mix of marker material to create a visible signature upon dispersal. The subassembly of ampoules 322 and 324, marker materials, and ampoule supporting device 320 is secured by a rim 340 that fits into the joint between outer wall 304 and 306 and first end cap 310. The second chamber 316 is defined by the space between ampoule supporting device 320, such as a thin walled carrier tray, bottom end cap 312 and side walls 304 and 306. Located within the second chamber is inert filler, marker materials, or combinations thereof. A striker element 326, containing an upper portion 328 projecting outwardly through front end cap 310 and a lower portion 330 directed toward ampoules 322 and 324, is used to provide a force rupture of the ampoules. As a force is exerted upon upper portion 328, striker element pushes downwardly, causing lower portion 330 to breach ampoules 322 and 324. Breach of ampoules 312 and 314 causes intermixing of the chemiluminescent reactant components to produce light.

In use, the impact of end caps 310 or 312 with a target results in a force sufficient to dislodge the end caps. Dislodgement of the end caps results in intermixing of the chemiluminescent reactant components with the inert filler mixture, marker materials, or combinations thereof located in the second chamber to form a chemiluminescent slurry. Dislodgement of the end caps further results in side wall failure and displacement of chemiluminescent slurry radially and outwardly. Hand grenade 300 may contain sub-munitions expelled along with the chemiluminescent slurry. As dispersed, the sub-munitions, which may be smaller weapons or additional light producing ampoules, act individually and independently from the generation of the chemiluminescent slurry. FIG. 3C is a cross section of a particular embodiment of hand grenade 300 illustrating side walls 304 and 306 being split longitudinally and interconnected through longitudinal seams 332 and 334. Simple adjustments in the joint design between components and the wall thickness and size of the rupturable ampoules along with the shape of the striker element allows variations in force required for activation. In this way, varying size, weight, or payload is possible.

Striker element 326 is prevented from contacting ampoules 322 and 324 by a safety pin 336. The safety pin serves the added purpose of reinforcing the retention of top end cap 310 and subsequently by association the outer walls 304 and 306 and therefore the overall structural integrity of the grenade.

To use the hand grenade, safety pin 336 is removed by the user pulling on ring 338. Striking element 326 is depressed manually or by striking against a sufficiently hard object, rupturing the ampoules 322 and 324. Rupture of ampoules allows the intermixing of the chemiluminescent reagents and creation of a glowing liquid within ampoule supporting device 320. Hand grenade 300 is then launched or thrown at a target. The forces of impact dislodge top end cap 310, instantly dispersing the chemiluminescent fluid and allowing outer walls 304 and 306 to fall away from the marker and/or filler mixture. Dislodgement of the side walls results in radial, outward displacement of the chemiluminescent slurry. Simple adjustments in the joint design between components and the wall thickness and size of the rupturable ampoules 322 and 324 along with the shape of the striking element 308 allow variations in force required for activation. In this way, varying size and weights or payload are possible.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and drawings/figures.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A light emitting projectile for marking and illuminating a target comprising:

a main body having frangible side walls;

at least one frangible ampoule containing chemiluminescent reactant components;

a substantially incompressible filler material positioned between said frangible side walls and said at least one ampoule;

a first end cap constructed and arranged to connect to a portion of said frangible side walls and to receive a portion of said at least one ampoule, said first end cap being traversable between a neutral position and a triggering position upon impact with an object, said traversal between said neutral position and said triggering position providing a force sufficient to rupture said frangible side walls as well as said one ampoule causing intermixing of said chemiluminescent reactant components and admixture with said substantially incompressible filler material to produce a chemiluminescent slurry, a second end cap constructed and arranged to connect to said frangible side walls and to receive a portion of said at least one ampoule; said second end cap providing sufficient energy transfer to said chemiluminescent slurry upon impact with a target to disperse said chemiluminescent slurry radially and outwardly with respect to the longitudinal axis of said main body.

2. The light emitting projectile for marking and illuminating a target according to claim 1 wherein said side walls are multicomponent, said multicomponent side walls having a first member side wall adjoined to a second member side wall.

3. The light emitting projectile for marking and illuminating a target according to claim 2 wherein said first member side wall is adjoined to said second member side wall along a frustoconical surface.

4. The light emitting projectile for marking and illuminating a target according to claim 1 wherein said at least one frangible ampoule is made of glass, plastic, or a combination thereof.

5. The light emitting projectile for marking and illuminating a target according to claim 1 wherein said first end cap contains an inner cavity for receiving a portion of said at least one ampoule.

6. The light emitting projectile for marking and illuminating a target according to claim 5 said inner cavity further contains a space between the base of said inner cavity and said portion of said at least one ampoule which is received by said inner cavity.

7. The light emitting projectile for marking and illuminating a target according to claim 1 wherein said second end cap contains an inner cavity for receiving a portion of said at least one ampoule.

8. The light emitting projectile for marking and illuminating a target according to claim 1 wherein said chemiluminescent slurry emits visible light.

9. The light emitting projectile for marking and illuminating a target according to claim 1 wherein said chemiluminescent slurry emits infrared light.

10. The light emitting projectile for marking and illuminating a target according to claim 1 wherein said chemiluminescent slurry emits ultraviolet light.

11. The light emitting projectile for marking and illuminating a target according to claim 1 wherein said components are made of biodegradable or inert materials.

12. The light emitting projectile for marking and illuminating a target according to claim 1 further adapted to fit to a grenade launcher.

13. The light emitting projectile for marking and illuminating a target according to claim 1 wherein said second end cap further contains an elongated body containing stabilizing fins.

14. The light emitting projectile for marking and illuminating a target according to claim 13 further containing an internal bore.

15. The light emitting projectile for marking and illuminating a target according to claim 14 further containing a bullet trap.

16. A light emitting projectile for marking and illuminating a target comprising:

a main body having multicomponent side walls, said multicomponent side walls having a first member side wall abut a second member side wall along a frustoconical surface;

at least one ampoule containing chemiluminescent reactant components;

a substantially incompressible filler material positioned between said multi-component side walls and said at least one ampoule;

a first end cap constructed and arranged to connect to said first member side wall and having at least one inner cavity to receive a portion of said at least one ampoule, said first end cap being traversable between a neutral position and a triggering position upon impact with an object, said traversal between said neutral position and said triggering position providing a force sufficient to rupture said side walls as well as said one ampoule causing intermixing of said chemiluminescent reactant and admixture with said substantially incompressible filler material to produce a chemiluminescent slurry, a second end cap constructed and arranged to connect to said second member side wall and having at least one inner cavity to receive a portion of said at least one ampoule; said second end cap providing sufficient energy transfer to said chemiluminescent slurry upon impact with a target to disperse said chemiluminescent slurry radially and outwardly with respect to the longitudinal axis of said main body.

17. The light emitting projectile for marking and illuminating a target according to claim 16 wherein said chemiluminescent slurry emits visible light.

18. The light emitting projectile for marking and illuminating a target according to claim 16 wherein said chemiluminescent slurry emits infrared light.

19. The light emitting projectile for marking and illuminating a target according to claim 16 wherein said chemiluminescent slurry emits ultraviolet light.

20. The light emitting projectile for marking and illuminating a target according to claim 16 wherein said components are made of biodegradable or inert materials.

21. The light emitting projectile for marking and illuminating a target according to claim 16 further adapted to fit to a grenade launcher.

22. The light emitting projectile for marking and illuminating a target according to claim 16 wherein said second end cap further contains an elongated body containing stabilizing fins.

23. The light emitting projectile for marking and illuminating a target according to claim 22 further contain an internal bore.

24. The light emitting projectile for marking and illuminating a target according to claim 23 further containing a bullet trap.

25. The light emitting projectile for marking and illuminating a target according to claim 23 wherein said first end cap further contains an ogive portion.

26. A light emitting hand grenade comprising:

a main body defined by side walls radially displaced along a longitudinal axis and constructed and arranged to engage a front end cap and a bottom end cap;

a first chamber defined by an ampoule supporting device constructed to hold at least one frangible ampoule containing chemiluminescent reactant components, and at least one frangible ampoule containing chemiluminescent reactant components;

a second chamber defined by the space between said ampoule supporting device, said bottom end cap and said side walls, said second chamber containing inert filler, marker materials, or combinations thereof; and an striker element containing an upper portion projecting outwardly through said front end cap and a lower portion directed towards said at least one ampoule, whereby a force exerted upon said upper portion causes said lower portion to breach said ampoules, causing intermixing of said chemiluminescent reactant components to produce light;

wherein impact of said end caps with a target results in a force sufficient to dislodge said end caps, whereby dislodgement of said end caps resulting in intermixing of said chemiluminescent reactant components with said inert filler mixture, marker materials, or combinations thereof located in said second chamber to form a chemiluminescent slurry, whereby dislodgement of said side walls results in radial, outwardly displacement of said chemiluminescent slurry.

27. The non-pyrotechnic, light emitting hand grenade according to claim 26 wherein said side walls are split longitudinally.

28. A light emitting grenade according to claim 26 wherein said chemiluminescent slurry emits visible light.

29. A light emitting grenade according to claim 26 wherein said chemiluminescent slurry emits infrared light.

30. A light emitting grenade according to claim 26 wherein said chemiluminescent slurry emits ultraviolet light.

31. A light emitting grenade according to claim 26 wherein said components are made of biodegradable or inert materials.

32. A light emitting grenade according to claim 26 wherein said at least one frangible ampoule is made of glass, plastic, or a combination thereof.

33. A light emitting grenade according to claim 26 wherein said ampoule further contains sub-munitions.

* * * * *